US009951664B2

(12) United States Patent
Pingen et al.

(10) Patent No.: US 9,951,664 B2
(45) Date of Patent: Apr. 24, 2018

(54) METHOD FOR HEATING THE ENGINE OIL OF AN INTERNAL COMBUSTION ENGINE AND INTERNAL COMBUSTION ENGINE FOR PERFORMING SUCH A METHOD

(75) Inventors: Bert Pingen, Swisttal (DE); Hans Guenter Quix, Herzogenrath (DE); Michael Tobergte, Cologne (DE); Kay Hohenboeken, Cologne (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 726 days.

(21) Appl. No.: 13/451,401

(22) Filed: Apr. 19, 2012

(65) Prior Publication Data

US 2012/0285413 A1 Nov. 15, 2012

(30) Foreign Application Priority Data

May 11, 2011 (DE) ..... 10 2011 075 666

(51) Int. Cl.
*F01M 5/02* (2006.01)
*F01M 5/00* (2006.01)

(52) U.S. Cl.
CPC ..... *F01M 5/02* (2013.01); *F01M 5/001* (2013.01); *F01M 5/021* (2013.01)

(58) Field of Classification Search
CPC ..... F01M 5/00; F01M 5/001; F01M 5/005; F01M 5/007; F01M 5/02; F01M 5/021
USPC ..... 123/196 AB, 196 R
See application file for complete search history.

(56) References Cited

U.S. PATENT DOCUMENTS

| | | | | |
|---|---|---|---|---|
| 4,114,571 | A * | 9/1978 | Ruf | 123/41.35 |
| 4,522,166 | A * | 6/1985 | Toivio et al. | 123/196 A |
| 4,541,368 | A * | 9/1985 | Castarede | 123/41.33 |
| 5,159,910 | A * | 11/1992 | Ninomiya et al. | 123/196 AB |
| 2005/0235760 | A1* | 10/2005 | Lo | 73/862 |
| 2008/0308050 | A1* | 12/2008 | Kuhlbach et al. | 123/41.82 R |
| 2010/0065001 | A1* | 3/2010 | Spicer et al. | 123/179.28 |
| 2011/0079187 | A1 | 4/2011 | Steiner et al. | |

FOREIGN PATENT DOCUMENTS

| | | | |
|---|---|---|---|
| DE | 60019025 | T2 | 8/2005 |
| DE | 102007043014 | A1 | 3/2009 |
| GB | 750037 | * | 2/1954 |

* cited by examiner

*Primary Examiner* — Jacob Amick
(74) *Attorney, Agent, or Firm* — Julia Voutyras; McCoy Russell LLP

(57) ABSTRACT

A method for operation of a lubrication circuit in an internal combustion engine is provided herein. The method comprises during a first operating condition, operating an oil agitation device to increase the turbulence of oil in the lubrication circuit, the oil agitation device positioned downstream of an oil pump in a supply line in fluidic communication with a lubricant receiving component.

20 Claims, 3 Drawing Sheets

METHOD FOR HEATING THE ENGINE OIL OF AN INTERNAL COMBUSTION ENGINE AND INTERNAL COMBUSTION ENGINE FOR PERFORMING SUCH A METHOD

RELATED APPLICATIONS

The present application claims priority to German Patent Application No. 102011075666.3, filed on May 11, 2011, the entire contents of which are hereby incorporated by reference.

BACKGROUND/SUMMARY

Lubrication systems are used in internal combustion engines to lubricate moving components to reduce friction within the components, thereby increasing the component's longevity. For example, pistons, crankshafts, bearings, etc., may all be lubricated with oil by a lubrication circuit provided in the engine. However, it may be desirable to operate the lubricant (e.g., oil) in the lubrication circuit within a desired operating temperature range to avoid over-temperature or under-temperature conditions which may lead to component degradation and increased wear. To avoid over temperature conditions, heat exchangers have been integrated into lubrication circuits to remove heat therefrom. As a result, the likelihood of the lubricant in the lubrication circuit experiencing an over-temperature condition may be reduced.

However, during cold starts in the internal combustion engine, the lubricant may experience an under-temperature condition. As a result, the viscosity of the oil is increased thereby increasing component wear and other types of degradation stemming from improper lubrication of components. Consequently, the longevity of the lubricated components in the engine may be reduced. Electric heaters have been integrated into oil pans in engine lubrication systems to avoid under temperature conditions. In this way, the oil may be actively heated during for example, a cold start, to decrease oil viscosity, thereby decreasing friction losses in lubricated components. Additionally, the oil may be stored in an insulated storage tank during periods when the engine is not performing combustion and subsequently used to lubricate various components during start-up.

However, electric heaters may consume energy from the vehicle's battery, decreasing the vehicle's efficiency. Moreover, electric heaters may have a limited life span which may be in part caused by oil degrading various parts of the heater. Additionally, heated oil that is insulated cannot be stored indefinitely and the temperature of the oil will eventually decrease below a desired level.

As such in one approach, a method for operation of a lubrication circuit in an internal combustion engine is provided. The method comprises during a first operating condition, operating an oil agitation device to increase the turbulence of oil in the lubrication circuit, the oil agitation device positioned downstream of an oil pump in a supply line in fluidic communication with a lubricant receiving component.

In this way, the oil temperature may be increased via the oil agitation device, thereby reducing the likelihood of under-temperature conditions during certain periods of engine operation. In one example, the first operating condition may be when the oil is below a predetermined threshold value. Thus, the oil may be heated during a cold-start. As a result, the likelihood of component degradation stemming from improper lubrication may be reduced.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
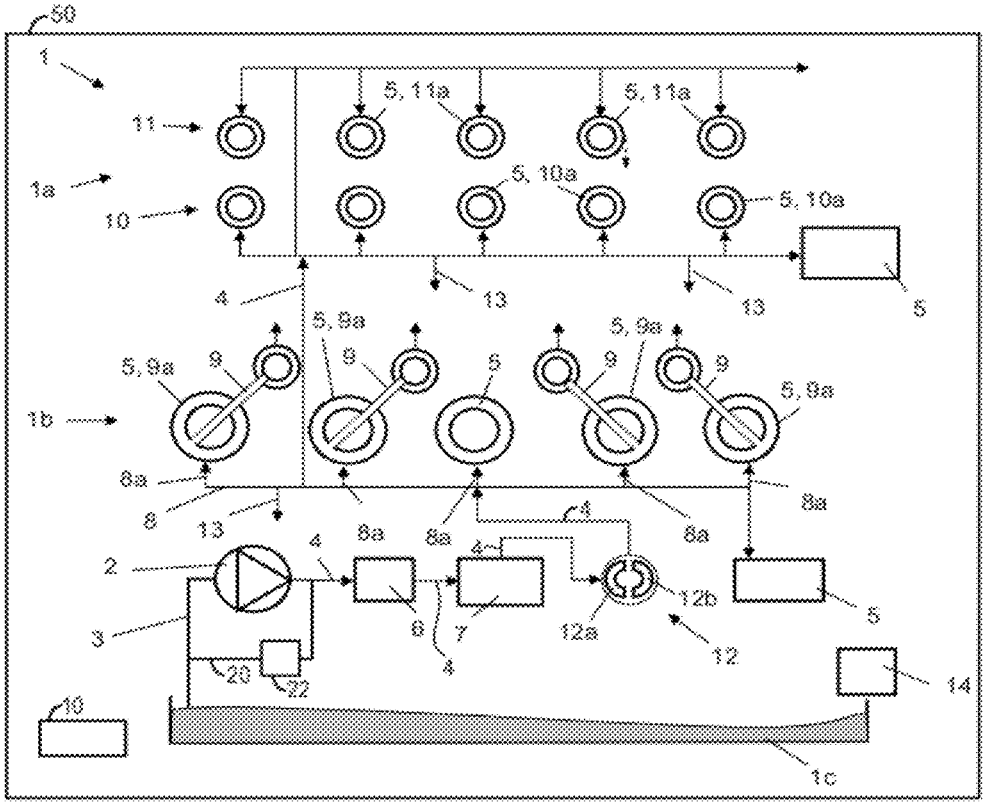
FIG. 1 schematically shows a first embodiment of an oil circuit in an internal combustion engine.

FIG. 1 schematically shows an embodiment of an oil circuit 1 in an internal combustion engine 50. The internal combustion engine 50 may be included in a vehicle 250, shown in FIG. 2, discussed in greater detail herein. The oil circuit 1 comprises a cylinder head oil circuit 1*a*, a cylinder block oil circuit 1*b* and an oil sump 1*c* for collecting and storing the engine oil.

In some embodiments, the oil sump 1*c* may include cooling fins, thereby increasing the exterior surface area of the sump, in order to improve the heat removal. The heat may be removed through convection by air flowing past the sump, due to the travelling motion of the vehicle. Additionally or alternatively, the heat transfer due to convection may be assisted by a fan. The choice of material used to produce the oil sump may be selected to increase heat removal, in some examples.

For pumping the engine oil through the oil circuit 1, an oil pump 2 is provided, a suction line 3 leading from the oil sump 1*c* to the oil pump 2, in order to supply the oil pump 2 with engine oil originating from the oil sump 1*c*. The suction line 3 may be sized to provide a desired delivery rate of oil to the pump 2. Moreover, the oil pump 2 may be sized to provide a desired amount of oil pressure in the oil circuit 1.

In some examples, the oil pump 2 may be mechanically driven. For example, rotational energy from a crankshaft 214, shown in FIG. 2, in the engine 50 may be used to drive the oil pump 2. However, in other examples, the oil pump 2 may be electrically driven. For example, a battery 10 may supply electrical power to the pump 2.

A pump bypass line 20 may be in fluidic communication with a supply line 4 and the suction line 3. Specifically, the bypass line 20 is in fluidic communication with oil lines directly upstream and downstream of the oil pump 2. A pressure relief valve 22 may be positioned in the pump bypass line 20. The pressure relief valve 22 may be configured to enable oil to flow through the pump bypass line 20 when the oil pressure in the line exceeds a predetermined threshold value. In this way, the pressure generated by the pump 2 may be controlled to reduce the likelihood of the pressure of the oil downstream of the pump increasing above undesirable levels. However, in other embodiments the oil circuit 1 may not include the bypass line 20.

For supplying the bearing with oil, the oil pump 2 is provided for delivering engine oil to at least the two bearings, the pump may supply engine oil via a supply line 4 to a main oil gallery 8, from which ducts lead to at least the two bearings. The supply line 4 may first pass through the cylinder block 200 before the supply line enters the cylinder head 202, shown in FIG. 2, described in greater detail herein.

Figure 2:
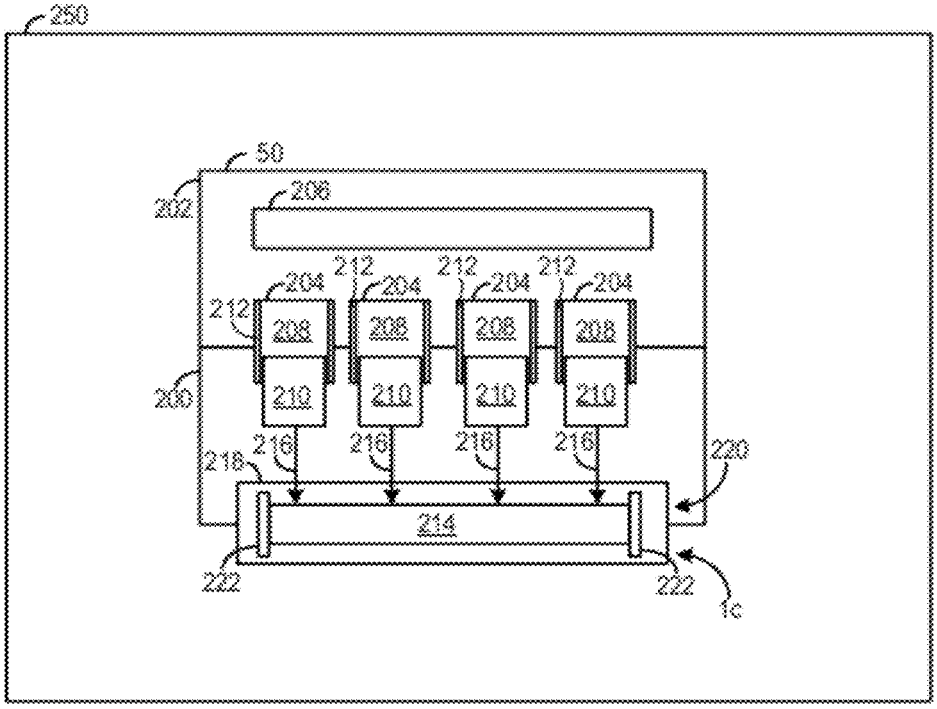
FIG. 2 shows a schematic depiction of the internal combustion engine shown in FIG. 1.

In some examples, the supply line 4 may lead from the pump 2 through the cylinder block 200, shown in FIG. 2, to the main oil gallery 8. After flowing through the main oil gallery 8, oil may be flowed to the cylinder head 202, shown in FIG. 2, in some examples.

The oil may be heated as it passes through the cylinder block, for which reason the downstream cylinder-head part of the oil circuit is in this case supplied with oil already preheated in the cylinder block, which is further heated in the head and finally returned to the oil sump 1*c*.

After the vehicle has been shut off, that is to say, after restarting the internal combustion engine 50, the oil may first flows through the cylinder block, where it is preheated. The preheated oil may then be heated further in the cylinder head, which due to the ongoing combustion processes reaches high temperatures more rapidly. The heating of the oil, that is to say the rise in the oil temperature, is more marked than in the case of a flow solely through the cylinder block.

In other examples, supply line 4 of the oil circuit 1 in the internal combustion engine 50 may supply oil to the cylinder head 202, shown in FIG. 2, before the supply line enters the cylinder block 200, shown in FIG. 2.

In some examples, it may be advantageous to quickly heat the oil, for example if the supply line 4 of the oil circuit 1 first leads to the cylinder head 202. At very low ambient temperatures, in particular, the fact that the cylinder head heats up more rapidly assists in rapid heating of the oil. This effect is even more clearly discernible if further optional design features are implemented, such as the integration of the manifold into the cylinder head. Such measures and further measures which assist or influence the heating of the oil in the cylinder head are explained further below, in addition to other developments of the internal combustion engine.

A main supply duct, which is aligned along the longitudinal axis of the crankshaft, may form at least a portion of the main oil gallery 8. The main supply duct may be arranged above or below a crankshaft 214 in a crankcase 218 or it may also be integrated into the crankshaft. The crankcase 218 and crankshaft 214 are shown in FIG. 2 and described in greater detail herein. In some examples, oil may be supplied to the two bearings non-continuously to increase the pressure in the oil circuit 1 and specifically in the main oil gallery 8. Control strategies for the oil circuit 1 are discussed in greater detail herein.

The oil pump 2 is configured to deliver the oil via the supply line 4 to the lubricant receiving components 5 provided in the oil circuit 1. Here the oil first flows through a filter 6, arranged downstream of the pump 2, and a coolant-operated oil cooler 7, which is arranged downstream of the filter 6 and which may be deactivated during the warm-up phase.

The oil cooler 7 may remove a greater amount of heat from the oil than air cooling of the oil, through the oil sump 1*c*, for example. In some examples, the oil cooler 7 may remove heat from the oil through air cooling and/or through liquid cooling. Specifically in some examples, the oil cooler 7 may utilize coolant from an engine cooling circuit. For example, coolant may be tapped off from the cooling circuit of the internal combustion engine 50 and delivered to the oil cooler 7, where it removes heat from the oil.

The filter 6 is arranged in the supply line 4. The filter 6 may retain particles, which can originate, for example, from the abrasion of moving parts and which might jeopardize the functional efficiency of the lubricant receiving components and units arranged in the oil circuit. Likewise, the coolant-operated oil cooler 7 is arranged in the supply line 4. The coolant-operated oil cooler 7 is positioned downstream of the filer 6. However, other arrangements have been contemplated.

For the purposes of the present invention the oil filter 6 is arranged in the supply line 4. The oil cooler 7 and/or the oil pump 2 intended for delivering the oil are not considered a lubricant receiving component 5. Although these components of the oil circuit are supplied with engine oil, the principle of an oil circuit entails the use of these components, the functions of which relate exclusively to the oil as such, whereas a lubricant receiving component makes the oil circuit needed in the first place.

The lubricant receiving components 5 may include at least two bearings (e.g., camshaft bearings, crankshaft bearings, etc.), camshaft mountings, and/or crankshaft mountings. The lubricant receiving components may be referred to as lubricated components. The lubricant receiving components 5 may be supplied with oil via the oil circuit 1, to lubricate the components to decrease wear in improve functionality. Additional lubricant receiving components that may be supplied with oil include a connecting rod, balancer shaft, and/or a piston head. The piston head may be sprayed with oil via a nozzle. Specifically, the nozzle may be positioned below the piston head. The lubricant receiving components 5 may further include a hydraulically actuated camshaft adjuster or other valve gear components, for hydraulic valve clearance adjustment.

The friction in the lubricant receiving components 5 supplied with oil, for example the crankshaft bearings, may vary as a function of the viscosity and thereby the temperature of the oil supplied thereto. Furthermore, the friction in the components may contribute to the fuel consumption of the internal combustion engine 50. Therefore, the temperature of the oil in the oil circuit 1 may be controlled to reduce the friction losses in the lubricant receiving components.

The supply line 4 leads through an oil agitation device 12, which serves to mechanically increase the friction in the engine oil and which is arranged between the first lubricant receiving component 5 and the oil pump 2. The device 12 includes a fixed stator 12*a* and a rotatably supported rotor 12*b*, which are situated opposite one another. A movement of the rotor 12*b* generates turbulences in the engine oil, the kinetic energy of which is converted due to friction into heat. This leads to an increase in the oil temperature. However, other configurations have been contemplated. When the oil is mechanically heated the efficiency of the engine is increased when compared to oil circuits which may electrically heat the oil. Moreover, the operation of the oil agitation device 12 may be matched to operating periods of the engine 50. Specifically, in some examples the rotor 12*b* may be coupled to a marine screw-type propeller configured to project into the supply line 4.

The turbulences generated via the propeller or rather the friction associated with the turbulences lead(s) to a temperature increase in the oil. This temperature increase occurs upstream of lubricant receiving components 5, so that already preheated oil of low viscosity can be fed to the lubricant receiving components 5. As a result, friction losses in the lubricant receiving components 5 are reduced.

When, the oil agitation device 12 is positioned downstream of the oil sump 1*c*, the distance between the oil agitation device 12 and the lubricant receiving components 5 is reduced thereby decreasing heat losses in the oil. As a result, the efficiency of the oil circuit 1 is increased.

In some example, the oil agitation device 12 may be mechanically driven. Thus, the oil agitation device 12 may include a mechanical drive component instead of the fixed stator 12*a*.

Specifically, the oil agitation device 12 may be driven via a flexible drive component (e.g., a belt drive, a chain drive). The flexible drive component may be rotatably coupled to a crankshaft in some examples. Additional flexible drive components may be included in the internal combustion engine to drive auxiliary units such as the oil pump 2, a coolant pump, an alternator, camshafts, etc. In some examples, the flexible drive component may serve a dual use. That is to say that the flexible drive component may provide rotational energy to the oil agitation device 12 as well as other auxiliary units in the vehicle.

When the oil agitation device 12 is mechanically driven, the oil agitation device may be operated during overrun conditions in the internal combustion engine 50 to decrease losses. Thus, the oil may be heated via the oil agitation device 12 without consuming additional fuel. The flexible drive component may be referred to as a tractive component.

In order to increase the reliability of the flexible drive component and decrease the wear on the component, the flexible drive component may be kept under tension which may be substantially constant. Keeping tension, such as constant tension, on the flexible drive component may be particularly useful when a belt drive is used. As a result, the likelihood of slipping of the flexible drive component is decreased. In some examples, slipping may be substantially avoided when constant tension is applied to the driver component.

In some examples, the mechanical drive component may be mechanically driven by a gear mechanism. In contrast to a flexible drive, the principle of a drive component having a gear mechanism enables a substantially slip-free drive. Gear mechanisms may comprise one or more gear pairs, the outstanding feature of which is their increased efficiency when compared to flexible drive components.

In other examples, the oil agitation device 12 may be electrically driven. Specifically, the battery 10 may provide power to the stator 12*a* in the oil agitation device 12. Driving the oil agitation device 12 electrically allows heating of the oil even prior to starting of the internal combustion engine 50. In this way, the oil may be prepared for starting. The battery 10 may be a vehicle battery charged during operation of the internal combustion engine 50, for example.

The oil agitation device 12 may be controlled electrically, hydraulically, pneumatically, mechanically, and/or magnetically. Specifically, an engine control 14 discussed in greater detail herein may be used to control the oil agitation device 12. A clutch may be provided for activating and deactivating the oil agitation device 12, particularly if the device is driven mechanically.

In some examples, the oil agitation device 12 may operate as a hydrodynamic retarder. Hydrodynamic retarders are used as reduced wear retarders in the sphere of commercial vehicles. A hydrodynamic retarder may comprise two rotationally symmetrical and opposing vane wheels. In this particular example, one vane wheel is designed as rotor, that is to say it is rotatably supported, whilst the other wheel is a fixed stator. When needed, oil may be fed into a housing of the hydrodynamic retarder accommodating the wheels. The rotor accelerates the oil delivered and the rotor vanes direct the oil into the stator, which in reaction to this in turn brakes the rotor. The friction converts the kinetic energy into heat, so that the temperature of the oil rises.

Downstream of the oil agitation device 12 the preheated oil, via a supply line 4, enters the main oil gallery 8, from which ducts 8*a* lead to the five main bearings 9*a* of the crankshaft 214, shown in FIG. 2, and the four big-end bearings 9, in order to supply the bearings with oil.

From the main oil gallery 8 arranged in the cylinder block the supply line 4 leads to the cylinder-head oil circuit 1*a*, in order to supply the bearings 10*a*, 11*a* of two camshaft mountings 10, 11 with oil, and to further lubricant receiving components 5.

Supply ducts branching off the main oil gallery may provide oil to the camshaft mountings (10 and 11). In some examples, the supply ducts may traverses the cylinder block and when the camshaft is an overhead camshaft, the supply ducts may traverse the cylinder head 202, shown in FIG. 2.

Alternatively, provision may be made for a supply line, which leads from the pump 2 directly into the cylinder head, supplies the camshaft mounting with engine oil and then—downstream—leads to the main oil gallery.

The oil circuit 1 further includes return lines 13 branching off from one of the two camshaft mountings 10 and the main oil gallery 8 flows the engine oil back into the oil sump 1*c* under gravity, after it has flowed through the lubricant receiving components 5. The return lines 13 are preferably positioned in low-temperature areas and/or adjacent to any liquid cooling provided for the cylinder head and/or cylinder block. In this way, the likelihood of the oil in the return lines 13 increasing beyond a desired operating temperature is decreased. It will be appreciated that an over temperature condition of the oil in the return lines 13 can adversely affect the oil's characteristics, in particular the lubricating quality, of the returning oil and can cause more rapid aging of the oil.

An engine control 14 serves for controlling the internal combustion engine and components of the oil circuit 1. The engine control 14 may include memory executable by a processor for executing the method described with regard to FIG. 3.

FIG. 2 shows the internal combustion engine 50. It will be appreciated that the components in FIG. 1 may also be included in the internal combustion engine 50, shown in FIG. 2. The internal combustion engine 50 may provide propulsion to a motor vehicle 250. In the context of the present invention the term in but also hybrid internal combustion engines, that is to say internal combustion engines which are operated by a hybrid combustion method.

The internal combustion engine 50 may include a cylinder block 200 and at least one cylinder head 202, the cylinder block and the cylinder head may be connected to one another to form the individual cylinders 204. The cylinders may be referred to as combustion chambers. The cylinder head 202 may include a cooling jacket 206 to provide liquid cooling.

The cooling jacket 206 may include coolant ducts carrying the coolant through the cylinder head 202. Here the coolant may be delivered via a pump arranged in the cooling circuit, so that it circulates in the coolant jacket. In this way the heat given off to the coolant is dissipated from the interior of the cylinder head and abstracted from the coolant again in a heat exchanger, and may also be used for heating the engine oil, for example during the warm-up phase.

The heat released in combustion by the exothermic, chemical conversion of the fuel is dissipated partially to the cylinder head 202 and the cylinder block 200 via walls defining the cylinders 204, and partially to the adjacent components and the surroundings via the exhaust gas flow. In order to keep the thermal load on the cylinder head within a desired range, a portion of the heat flow introduced into the cylinder head may be abstracted from the cylinder head again.

An exhaust manifold integrated in the cylinder head has several advantages. Downstream of the manifold the exhaust gases are often fed to the turbine of an exhaust turbocharger and/or to one or more exhaust gas aftertreatment system(s). On the one hand efforts may be made to arrange the turbine close to the exhaust ports of the cylinders, so that exhaust gas enthalpy of the hot exhaust gases may be used, which may be determined by the exhaust gas pressure and the exhaust gas temperature, and to provide a rapid response behavior of the turbocharger. On the other hand, the path taken by the hot exhaust gases to the various exhaust gas aftertreatment systems may be decreased to allow the exhaust gases little time to cool and the exhaust gas aftertreatment systems reach their operating temperature or start-up temperature quickly, particularly after cold starting of the internal combustion engine.

For the aforementioned reasons, it may be desirable to reduce the thermal inertia of the portion of the exhaust line between the exhaust port on the cylinder and the exhaust gas aftertreatment system or between the exhaust port on the cylinder and the turbine, which may be achieved by reducing the mass and the length of this portion.

In order to achieve the aforementioned aims, the exhaust lines may be combined within the cylinder head. This measure also allows the more compact packaging of the power unit.

In some examples, the cylinder head 202 may include four cylinders arranged in line, for example, in which the exhaust lines of the outer cylinders and the exhaust lines of the inner cylinders are in each case combined into one overall exhaust line, may also be used to form the internal combustion engine. However in other embodiments, the exhaust lines of all cylinders of at least the cylinder head inside the cylinder head to form a single, that is to say common, overall exhaust line. A cylinder head with integrated exhaust manifold is subjected to a greater thermal load than other types of cylinder heads, which is equipped with an external manifold, and therefore places greater demands on the cooling, for which reason liquid cooling may be useful in a cylinder head with integrated exhaust manifold.

The integration of the exhaust manifold into the cylinder head helps to further reduce the friction loss of the internal combustion engine. This is because a cylinder head with integrated manifold may reach higher temperatures more rapidly than a conventional cylinder head having an external manifold, particularly in the warm-up phase after cold starting of the internal combustion engine. Consequently, it may be desirable to integrate the manifold into the cylinder head, in order to heat up the engine oil fed through the cylinder head as rapidly as possible after cold starting. Furthermore, liquid cooling of the cylinder head may decrease or in some cases limit the temperature rise of the oil and may even assist the heating of the oil in the warm-up phase.

Owing to the high heat capacity of a liquid, large amounts of heat may be dissipated. The heat does not have to first be conducted to the cylinder head surface in order to be dissipated, as in the case of air cooling. The heat may be given off to the coolant, generally water mixed with additives, right there inside the cylinder head.

The cylinder head 202 may include at least one exhaust port per cylinder for carrying off the exhaust gases and an exhaust line connected to each exhaust port. The exhaust lines from the cylinders may unite into one overall exhaust line. The overall exhaust line may form an integrated exhaust manifold inside the one cylinder head 202.

The cylinder block 200 comprises a corresponding number of cylinder bores 208 for receiving pistons 210 and cylinder liners 212. The piston of each cylinder of an internal combustion engine is guided so that it is axially moveable in a cylinder liner and together with the cylinder liner and the cylinder head defines the combustion chamber of a cylinder. Here the piston head forms a part of the inner wall of the combustion chamber and together with the piston rings seals the combustion chamber from the cylinder block and the crankcase, so that the combustion gases or combustion air flowing into the crankcase is substantially reduced and in some case eliminated. The piston ring seals may also reduce the likelihood of oil flowing into the combustion chambers.

The pistons 210 are configured to transmit the gas forces generated by the combustion to a crankshaft 214. For this purpose the piston may be articulated via a piston pin to a connecting rod, which is in turn rotatably supported on the crankshaft. This linkage is denoted via arrows 216.

The crankshaft 214 may be supported by a crankcase 218. Furthermore, the crankshaft 214 may absorbs the connecting rod forces, which may be composed of the gas forces resulting from the fuel combustion in the combustion chambers and the inertial forces resulting from the irregular movement of the engine parts. Here the oscillating reciprocating movement of the pistons is translated into a rotational movement of the crankshaft, in which the crankshaft transmits the torque to a drivetrain. A proportion of the energy transmitted to the crankshaft 214 may be used to drive auxiliary units, such as the oil pump and the alternator, or serves to drive the camshaft and thereby to actuate the valve gear. Here the camshaft is often supported in the cylinder head as an overhead camshaft.

An upper portion 220 of the crankcase 218 may be formed by the cylinder block 200. Furthermore, the crankcase 218 may also include a lower portion which may serve as the oil sump 1*c*. In some examples, the upper portion 220 of the crankcase 218 may comprise a flange face to receive the oil sump 1*c*, that is to say the lower portion of the crankcase. A gasket may be provided in or on the flange face to seal the oil sump 1*c* and/or the crankcase 218 off from the surroundings. The connection is a bolted connection, for example. The oil sump 1*c* may be configured to collect and store the engine oil and is part of the oil circuit. In addition, the oil sump may also act as a heat exchanger for reducing the oil temperature when the internal combustion engine 50 has been heated to operating temperature. In this case the oil in the oil sump is cooled due to thermal conduction and convection by means of an air flow passing the outside of the sump.

At least two bearings 222, which as a rule are of two-part design and which each comprise a bearing saddle and a bearing cap that can be connected to the bearing saddle, are provided in the crankcase 218 for receiving and supporting the crankshaft 214. The bearings 222 may be the crankshaft bearing 9*a*, shown in FIG. 1. The crankshaft may be supported in the area of the crankshaft journals, which may be spaced at an interval from one another along the crankshaft axis and as a rule are embodied as thicker shaft shoulders. Here the bearing caps and bearing saddles may be designed as separate components or integrally formed with the crankcase, that is to say the portions of the crankcase. Bearing shells may also be arranged as intermediate elements between the crankshaft and the bearings.

In the assembled state each bearing saddle is connected to the corresponding bearing cap. One bearing saddle and one bearing cap, possibly interacting with bearing shells as intermediate elements, in each case form a bore for receiving a crankshaft journal. The bores may be supplied with engine oil, that is to say lubricating oil, so that as the crankshaft rotates a load-bearing lubricating film is formed between the inside face of each bore and the associated crankshaft journal, similar to a slide bearing.

Figure 3:
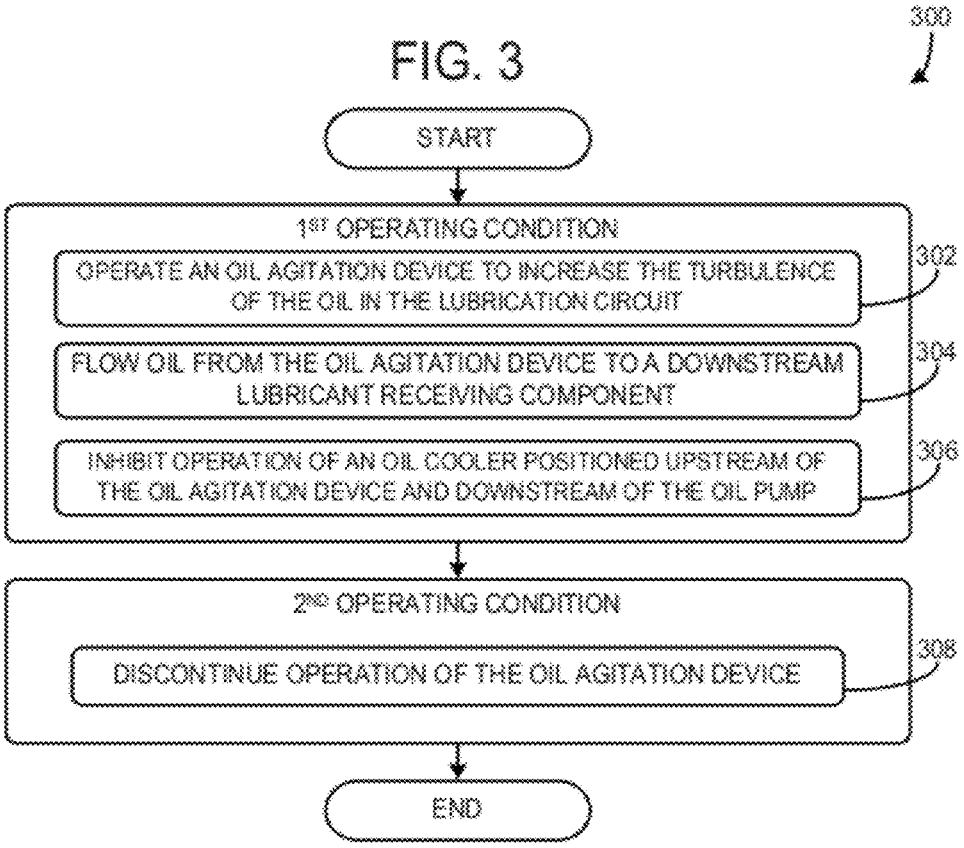
FIG. 3 shows a method for operation of an oil circuit.

FIG. 3 shows a method 300 for operating an oil circuit. The method 300 may be used to operate the oil circuit 1 described above with regard to FIGS. 1 and 2 or may be used to operate another suitable oil circuit.

The method includes at 302 operating an oil agitation device to increase the turbulence of the oil in an oil circuit. The oil circuit may be the oil circuit discussed above with regard to FIGS. 1 and 2 or may be another suitable oil circuit. Specifically, the oil agitation device may be positioned in a supply line in fluidic communication with an outlet of an oil pump and lubricant receiving component. The oil agitation device may be positioned upstream of the lubricant receiving component.

At 304 the method includes flowing oil from the oil agitation device to a downstream lubricant receiving component. Next at 306 the method includes inhibiting operation of an oil cooler positioned upstream of the oil agitation device and downstream of the oil pump. At 308 the method includes discontinuing operation of the oil agitation device.

Steps 302-306 are implemented during a first operating condition. The first operation condition may be when the oil is below a predefined threshold temperature. Additionally or alternatively, the first operating condition may be subsequent to start-up operation in the engine when the engine is below a predetermined threshold temperature. Additionally or alternatively, the first operating condition may be an overrun condition in which there is no power demand on the internal combustion engine requested via the driver.

On the other hand step 308 is implemented during a second operating condition. The second operating condition may be when the oil temperature exceeds a predefined temperature. Additionally or alternatively, the second operating conditions may be when the oil temperature exceeds a predefined temperature for a predetermined length of time.

Method 300 enables the oil as well as the internal combustion engine in which the lubricant receiving component is positioned to be rapidly heated. Rapid heating may be particularly useful during or after a cold start. Rapid heating of the engine oil during the warm-up phase of the internal combustion engine provides a rapid reduction of the viscosity and thereby a reduction of the friction or friction loss, particularly in the lubricant receiving component. As previously discussed the lubricant receiving component may be a bearing.

Furthermore, heating the oil after a cold start via the oil agitation device not only reduces the friction loss in components supplied with oil but also enables the internal combustion engine to reach a desired operating temperature more rapidly. Thus, exhaust gas aftertreatment systems are heated more rapidly. As a result, emissions of unburned hydrocarbons from the engine are reduced. Furthermore, the distinguishing feature of this variant of the method 300 is a use of the method for heating the engine oil designed to meet a desired need. For the same reasons, embodiments of the method in which the oil agitation device is activated in the warm-up phase, in order to heat the engine oil, are also advantageous.

Additionally, embodiments of the method in which the device is activated in overrun conditions of the internal combustion engine are advantageous. This variant of the method enables a mechanical driving of the device without additional fuel consumption, that is to say the oil is heated without consuming additional fuel, if desired. If the driver, via the accelerator pedal, demands a torque, for the purpose of acceleration, for example, this power demand is catered for by the variant of the method in question, that is to say that the torque demand may be given priority over heating of the engine oil, if desired.

After cold starting and in the warm-up phase the oil agitation device for increasing the friction in the oil may be activated when there is no power demand on the part of the driver, in some embodiments. For example, in overrun conditions or in the specific case of deceleration, that is to say during a braking operation. In this respect this variant of the method is similar to a process which may be used in systems for recovering energy.

Embodiments of the method in which the device is deactivated when the oil temperature exceeds a predefined oil temperature decrease the likelihood of the oil temperature exceeding a threshold value. As a result, the likelihood of component damage from over-temperature conditions may be reduced. In this case, the oil heating may be interrupted if an instantaneous need for lubrication no longer exists.

Variants of the method in which the device is deactivated as soon as the oil temperature exceeds a predefined oil temperature and is greater than this predefined oil temperature for a predefined length of time $\Delta t_1$ may also be beneficial in reducing the likelihood of an over-temperature condition.

The introduction of an additional condition (i.e., time) for the deactivation of the oil agitation device reduces the likelihood of the oil agitation device being activated and deactivated too frequently. For example, the oil temperature may exceed the predefined oil temperature only briefly, and then fall again or fluctuates around the predefined value for the oil temperature, without the excess temperature justifying or requiring a cut-out of the agitation device.

Cooling the engine oil in the warm-up phase of the internal combustion engine is at odds with the aim of reducing the friction loss through heating of the oil. Therefore, the oil cooler may be activated only when desired and may be inhibited from activation during a warm-up phase, if desired. In some embodiments, however, when the coolant during the warm-up phase heats up more rapidly than the engine oil, the oil cooler may be activated, contrary to its function, for heating the oil.

LIST OF REFERENCE NUMERALS

1 oil circuit
1*a* cylinder-head oil circuit
1*b* cylinder-block oil circuit
1*c* oil sump
2 pump
3 suction line
4 supply line
5 lubricant receiving component
6 filter
7 oil cooler
8 main oil gallery
8*a* ducts
9 big-end bearing
9*a* crankshaft bearing, main bearing

10 camshaft mounting
10*a* bearing of the camshaft mounting
11 camshaft mounting
11*a* bearing of the camshaft mounting
12 oil agitation device
12*a* stator
12*b* rotor
13 return line
14 engine control
50 internal combustion engine
200 cylinder block
202 cylinder head
204 cylinders
206 cooling jacket
208 cylinder bores
210 pistons
212 cylinder liners
214 crankshaft
216 linkage
218 crankcase
220 upper portion
222 bearings
250 vehicle

The invention claimed is:

1. A method for operating a lubrication circuit, comprising:

during a first operating condition, operating a hydrodynamic retarder including two rotationally symmetrical and opposing vane wheels to mechanically increase a turbulence of oil in the lubrication circuit, the hydrodynamic retarder positioned upstream of cylinder block lubricant-receiving components and downstream of an oil pump in a supply line, the circuit, including the pump, hydrodynamic retarder, and components positioned in an internal combustion engine.

2. The method of claim 1, where the first operating condition is when the oil is below a predefined threshold temperature, where the hydrodynamic retarder is controlled electrically, hydraulically, pneumatically, or magnetically.

3. The method of claim 1, where the first operating condition is subsequent to start-up operation in the engine when the engine is below a predetermined threshold temperature, wherein the internal combustion engine includes a cylinder head and a cylinder block, and wherein the pump and hydrodynamic retarder are positioned in a cylinder-block circuit.

4. The method of claim 1, where the first operating condition is an overrun condition in which there is no power demand on the internal combustion engine requested by a driver.

5. The method of claim 3, further comprising during a second operating condition, discontinuing operation of the hydrodynamic retarder.

6. The method of claim 5, where the second operating condition is when an oil temperature exceeds a predefined temperature.

7. The method of claim 5, where the second operating condition is when an oil temperature exceeds a predefined temperature for a predetermined length of time.

8. The method of claim 1, further comprising during the first operating condition inhibiting operation of an oil cooler positioned upstream of the hydrodynamic retarder and downstream of the oil pump.

9. A lubrication circuit for an internal combustion engine comprising:

an oil pump including a suction line positioned in an oil sump; and a hydrodynamic retarder including two rotationally symmetrical and opposing vane wheels positioned in a supply line in fluidic communication with the oil pump positioned upstream of the hydrodynamic retarder and a lubricant receiving component positioned downstream of the hydrodynamic retarder, the hydrodynamic retarder configured to mechanically increase a turbulence of oil in the supply line, the oil pump, hydrodynamic retarder, and lubricant receiving component positioned in the engine.

10. The lubrication circuit of claim 9, where the hydrodynamic retarder is electrically driven, and wherein the internal combustion engine includes a cylinder head and a cylinder block, and wherein the pump and hydrodynamic retarder are positioned in a cylinder-block circuit.

11. The lubrication circuit of claim 9, where the hydrodynamic retarder is mechanically driven.

12. The lubrication circuit of claim 11, where the hydrodynamic retarder is mechanically driven by a flexible drive.

13. The lubrication circuit of claim 11, where the hydrodynamic retarder is mechanically driven by a gear mechanism.

14. The lubrication circuit of claim 9, further comprising a cylinder head coupled to a cylinder block and forming an upper portion of a crankcase, the cylinder block coupled to the oil sump forming a lower portion of the crankcase and housing oil.

15. The lubrication circuit of claim 9, further comprising a moving component in fluidic communication with an outlet of the hydrodynamic retarder.

16. The lubrication circuit of claim 9, where the supply line traverses a cylinder block and subsequently a cylinder head.

17. The lubrication circuit of claim 9, where the supply line traverses a cylinder head and subsequently a cylinder block.

18. The lubrication circuit of claim 9, where the hydrodynamic retarder includes a stator and a rotor.

19. A lubrication circuit for an internal combustion engine comprising:

an oil pump including a suction line positioned in an oil sump, the oil sump positioned in the engine; and a hydrodynamic retarder including two rotationally symmetrical and opposing vane wheels positioned in a supply line in fluidic communication with the oil pump positioned upstream of the hydrodynamic retarder and a moving component positioned downstream of the hydrodynamic retarder, the hydrodynamic retarder including a stator and a rotor configured to mechanically increase a turbulence of the oil in the supply line, the engine including an exhaust integrated within a cylinder head, the oil pump hydrodynamic retarder, and moving component positioned in the engine, the hydrodynamic retarder mechanically driven by the engine; and an oil cooler positioned in the supply line between the hydrodynamic retarder and the pump, and further positioned in the engine and upstream of an oil sump in the engine, the pump drawing oil from the sump, the oil in the engine from the pump, to the cooler, to the hydrodynamic retarder, to the moving component, to the sump, and back to the pump.

20. The method of claim 1, where the hydrodynamic retarder is mechanically driven by the internal combustion engine.

* * * * *